United States Patent [19]

Finn et al.

[11] Patent Number: 5,060,400

[45] Date of Patent: Oct. 29, 1991

[54] OPEN TOE/OPEN HEEL SHOE HAVING REPLACEABLE INNER SOLE

[75] Inventors: Norman H. Finn, Newton, Mass.; Herbert W. Hirsch, Salem, N.H.

[73] Assignee: AmAsia International, Ltd., Stoneham, Mass.

[21] Appl. No.: 607,849

[22] Filed: Oct. 31, 1990

Related U.S. Application Data

[63] Continuation of Ser. No. 371,758, Jun. 27, 1989, abandoned.

[51] Int. Cl.[5] ..... A43B 03/12

[52] U.S. Cl. ..... 36/12; 36/11.5

[58] Field of Search ..... 36/11.5, 11, 12, 100, 36/101

[56] References Cited

U.S. PATENT DOCUMENTS

| | | | |
|---|---|---|---|
| D. 87,016 | 5/1932 | Meyer | 36/11.5 X |
| 2,761,224 | 9/1956 | Gardiner | 36/11.5 |
| 2,948,070 | 8/1960 | Lewis | 36/2.5 |
| 3,160,963 | 12/1964 | Aaskov | 36/11.5 |
| 3,398,468 | 8/1968 | Weitzner | 36/2.5 |
| 3,410,006 | 11/1968 | Vogel | 36/3 |
| 3,599,353 | 8/1971 | Magidson | 36/11.5 |
| 3,902,259 | 9/1975 | Cracco | 36/11.5 |
| 4,020,569 | 5/1977 | Fukuoka | 36/29 |
| 4,062,132 | 12/1977 | Klimaskewski | 36/100 |
| 4,267,649 | 5/1981 | Smith | 36/101 |
| 4,348,820 | 9/1982 | D'Alessio | 36/11.5 X |
| 4,369,537 | 1/1983 | Midgley | 12/142 RS |
| 4,439,935 | 4/1984 | Kelly | 36/101 |
| 4,535,554 | 8/1985 | De Obaldia | 36/113 |
| 4,689,899 | 1/1988 | Larson et al. | 36/44 |
| 4,727,661 | 3/1988 | Kuhn | 36/100 |
| 4,742,625 | 5/1988 | Sydor et al. | 36/3 R |

*Primary Examiner*—Steven N. Meyers

*Attorney, Agent, or Firm*—Jeffrey H. Ingerman; Gerard A. deBlasi

[57] ABSTRACT

Methods and apparatus for securing a replaceable inner sole to an open toe/open heel shoe are provided. Flaps are provided at the toe and heel portions of the unit bottom of the shoe. The replaceable inner sole is positioned within slots formed by the flaps. The flaps may extend around the front and rear of the shoe to prevent forward and rearward slippage, and may extend along the sides of the shoe to prevent lateral slippage. The flaps may be tapered to help eliminate irritation of the wearer's foot. A specially contoured last for pressing the sole of a shoe having toe and heel flaps is also provided.

18 Claims, 10 Drawing Sheets

OPEN TOE/OPEN HEEL SHOE HAVING REPLACEABLE INNER SOLE

This is a continuation of application Ser. No. 07/371,758, filed June 27, 1989, now abandoned.

BACKGROUND OF THE INVENTION

This invention relates to shoes having replaceable inner soles, and more particularly to an open toe/open heel shoe having a structure for retaining replaceable inner soles.

Although replaceable inner soles are widely used in closed toe and closed heel shoes, they are not often used in open toe and open heel shoes. The toe and heel portions of enclosed shoes hold the replaceable inner soles in the proper position during wear. When used with open toe or open heel shoes, replaceable inner soles tend to sip out of position. This may cause discomfort for the person wearing the shoe, and may damage the inner sole itself.

Prior attempts to keep replaceable inner soles properly positioned within open toe or open heel shoes have involved attaching the inner sole to the insole with snap fasteners, screws, or tongue-and-groove straps. The manufacture of shoes having such fastening systems is difficult and possibly labor-intensive. Also, fasteners such as screws may only be used with hard materials, such as wood. These fastening systems may also be difficult for the wearer to use. For example, inner soles fastened with screws require a screwdriver to be disassembled and reassembled.

Another attempt to provide a replaceable inner sole for open toe or open heel shoes involved an interlocking pin and hole system and inflation of the inner sole with air. The air pressure tightened the inner sole around the pins and against a lip of the shoe base. One drawback associated with inflatable inner soles is that the inner sole may be punctured. In addition, an inflatable inner sole must be made of a polymeric material if it is to hold air under pressure. A sole made of such material would lack perspiration-absorbing properties unless it were covered by an absorbent material.

Other systems have been used to retain replaceable inner soles which extend over only a portion of the shoe base. These systems use projections extending from the inner sole which fit into recesses in the shoe base, or vice-versa. These systems rely on the force applied by the wearer's foot to keep the projections within the recesses. If the shoe is held upside-down, for example, the removable inner sole may fall out.

It would be desirable to provide a shoe having a replaceable inner sole and a simple system for retaining the inner sole in the proper position, regardless of whether or not the shoe is being worn. It would also be desirable that such a shoe be easily manufactured.

SUMMARY OF THE INVENTION

In view of the foregoing, it is an object of this invention to provide an open toe or open heel shoe having a replaceable inner sole.

It is a further object of this invention to provide an open toe or open heel shoe having a simple system for retaining a replaceable inner sole in the proper position.

It is another object of this invention to provide an open toe or open heel shoe which is easily manufactured.

It is still another object of this invention to provide an open toe or open heel shoe which will remain in the proper position, regardless of whether or not the shoe is being worn.

These and other objects of the invention are accomplished by providing an open toe/open heel shoe having sturdy, yet flexible, flaps at the front and back of the unit bottom. A replaceable inner sole may be manually inserted with its edges beneath the flaps. The flaps retain the inner sole in the proper position and prevent the inner sole from slipping while the shoe is being worn. The flaps prevent the inner sole moving, even when the shoe is not being worn.

The flexible flaps which hold the inner sole in place preferably are tapered to prevent discomfort to the toes or the heel of the wearer. The flaps are formed from thermoplastic rubber.

The unit bottom portion of the preferred embodiment of the shoe (the shoe base) preferably is injection molded. The unit bottom is designed to accept an upper and a specially designed insole. The upper is shaped to fit behind the toe flap and in front of the heel flap. The insole covers the portion of the upper which contacts the unit bottom. The insole fits within a contoured recess of the unit bottom.

A special last is preferably provided, having recesses in the front and back to prevent the last from contacting the toe and heel flaps during the sole pressing step of the shoe assembly process.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which.

DETAILED DESCRIPTION OF THE INVENTION

Figure 1:
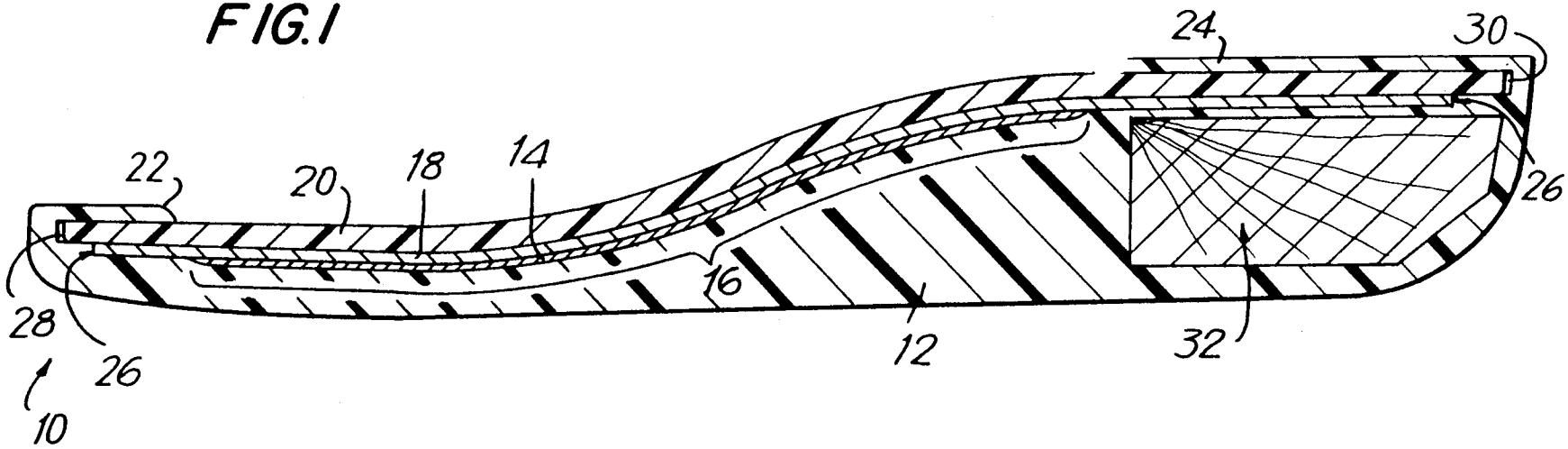
FIG. 1 is a longitudinal cross-sectional view of an illustrative embodiment of a shoe according to this invention.

Referring now to the drawings, FIGS. 1–8 show an illustrative embodiment of an open toe/open heel shoe constructed in accordance with the principles of this invention. The shoe, designated generally by reference numeral 10, includes a unit bottom 12, an upper 14, an insole 18, and a replaceable inner sole 20.

Shoe 10 is constructed by attaching upper 14 to the shank area 16 of unit bottom 12. Insole 18 is attached to unit bottom 12 so as to cover upper 14. Both insole 18 and upper 14 are permanently affixed to the unit bottom, in a conventional manner, such as by glueing. Replaceable inner sole 20 is held beneath a flap 22 at the front of shoe 10, and beneath a flap 24 at the rear of shoe 10.

Figure 2:
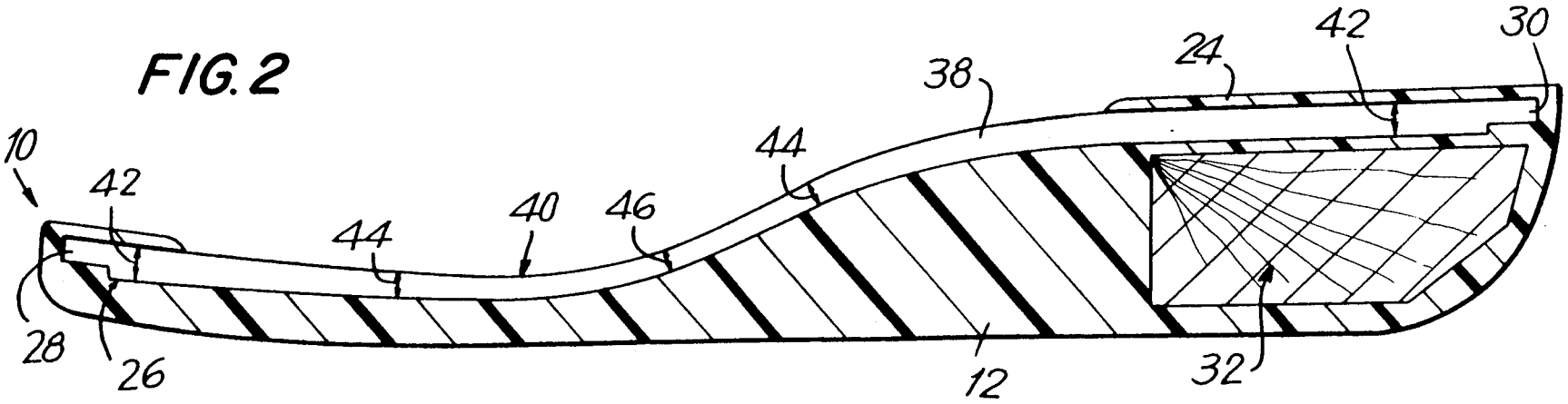
FIG. 2 is a longitudinal sectional view of the unit bottom of the shoe of FIG. 1.

FIG. 2 shows unit bottom 12, with the upper, insole, and inner sole removed. Unit bottom 12 is preferably formed of injection molded, thermoplastic rubber. However, unit bottom 12 may be formed of any other material suitable for molding, such as polyvinyl chloride, ethylene-vinyl acetate copolymer, styrene, or polyurethane. Unit bottom 12 also may be formed using an open-pour mold, in lieu of injection molding. If polyurethane is used, it may be formed using the open-pour molding process. In the preferred embodiment, wood core 32 is included within the unit bottom. Flap 22, disposed at the front portion of unit bottom 12, extends partially across a recess 38, forming a slot 28. Similarly, flap 24, disposed at the rear portion of unit bottom 12, extends partially across recess 38 to form slot 30. A molded inset 26 is formed in recess 38 to receive upper 14 and insole 18. Inset 26 is contoured to follow the shape of insole 18.

Recess 38 extends from the front to the rear of unit bottom 12. In this embodiment (FIG. 2), recess 38 preferably extends below rim 40 approximately three millimeters at point 46, and gradually increases to a maximum of approximately five millimeters at the points labeled 42. At the points labeled 44, the depth of recess 38 preferably is approximately 3.5 millimeters. The edge of inner sole 20 is not covered by a flap at point 46, permitting a greater design tolerance for the depth of recess 38 at this point. At points 42, the depth of recess 38 must be selected such that inner sole 20 fits easily, yet securely within slots 28 and 30.

Figure 3:
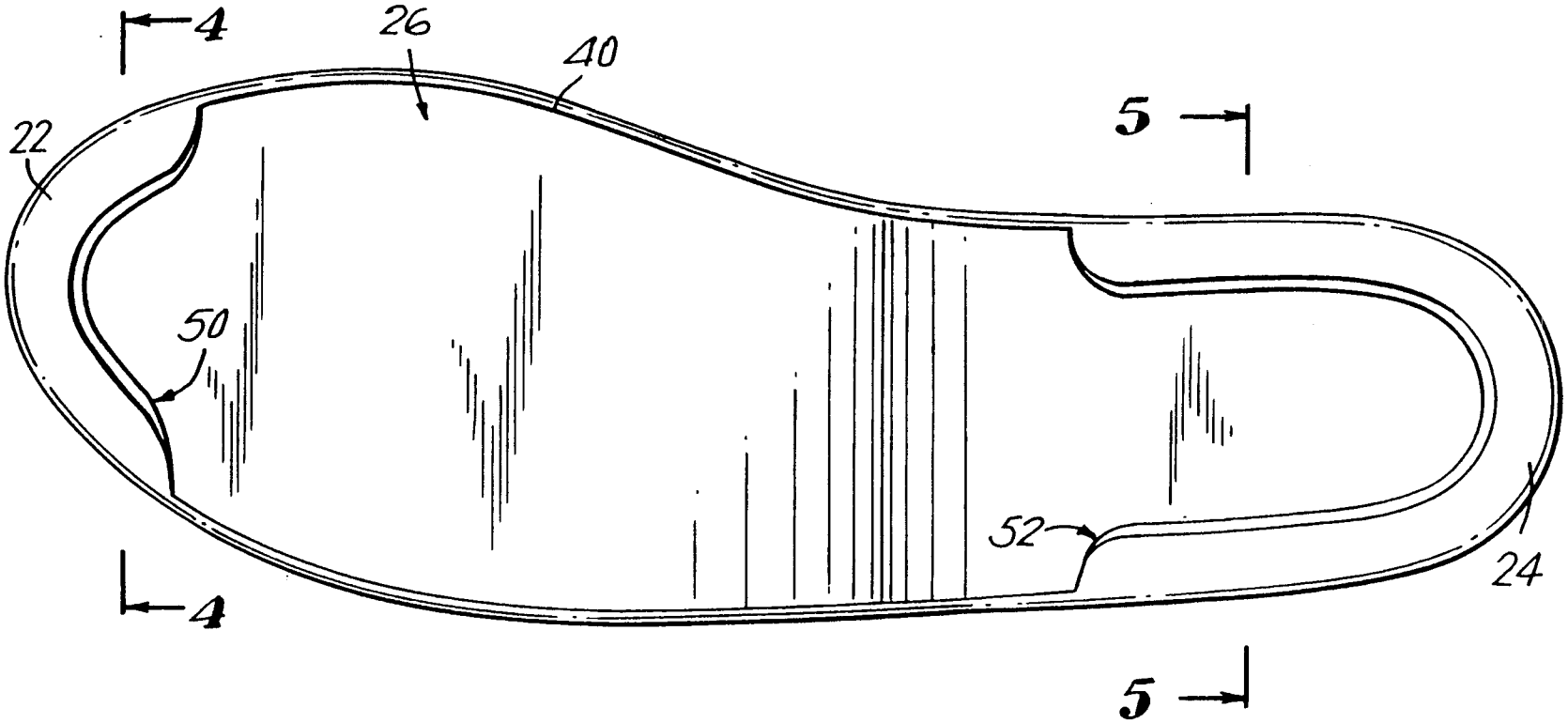
FIG. 3 is a top view of the unit bottom of FIG. 2.

Referring now to FIG. 3, front flap 22 extends around the front of unit bottom 12. In the preferred embodiment shown, front flap 22 has a substantially semi-circular shape. In alternative embodiments, the shape of front flap 22 will be determined by the shape of the shoe's toe portion. For example, front flap 22 may be pointed, square, or any other desired shape. Flap 22 prevents inner sole 20 from slipping forward during wear, and it extends around to the sides to prevent lateral slippage. Rear flap 24 extends around the heel portion of unit bottom 12. Flap 24 has a rearmost portion, which is substantially semi-circular in shape, and two side portions, which extend toward the front of the shoe substantially parallel to each other. Flap 24 prevents inner sole 20 from slipping rearwardly and laterally during wear. Generally, flaps 22 and 24 extend as far rearward and forward as possible, respectively, until they reach upper 14 (see FIGS. 7 and 8, below). Flaps 22 and 24 extend inward from rim 40 approximately ten millimeters, causing inner sole 20 to remain in the proper position at all times, regardless of whether or not the shoe is being worn.

Inset 26 of unit bottom 12 is contoured to receive insole 18. Recessed contour 50, at the toe portion of the unit bottom, is shaped to receive the correspondingly shaped contour 58 of insole 18 (shown in FIG. 6). Recessed contour 52, at the heel portion of the unit bottom, is shaped to receive the correspondingly shaped contour 60 of insole 18. Inset 26 is bounded by contours 50 and 52 at flaps 22 and 24, respectively, and by rim 40. Inset 26 does not extend beneath either of flaps 22 or 24.

Figure 4:
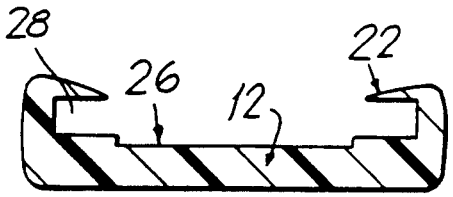
FIG. 4 is a cross-sectional view of the unit bottom of FIG. 3, taken along line 4'4 of FIG. 3.
Figure 5:
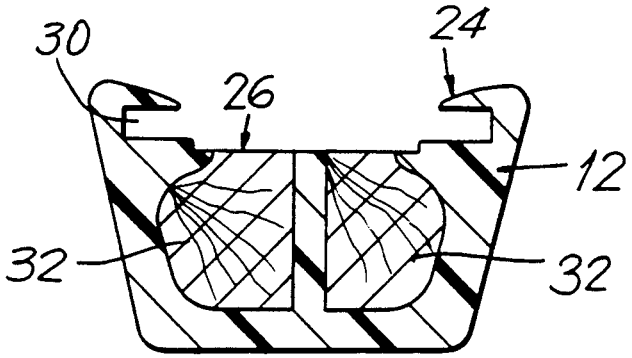
FIG. 5 is a cross-sectional view of the unit bottom of FIG. 3, taken along line 5—5 of FIG. 3.

FIGS. 4 and 5 show cross-sections of unit bottom 12 taken along lines 4—4 and 5—5 of FIG. 3, respectively. During shoe wear, flaps 22 and 24 normally contact the wearer's foot. For this reason, the flaps must be sufficiently thin to prevent discomfort. Flaps 22 and 24 are preferably tapered, such that they are thickest at rim 40, and become thinner as they extend inward. In the preferred embodiment, the flaps are made of thermoplastic rubber.

Figure 6:
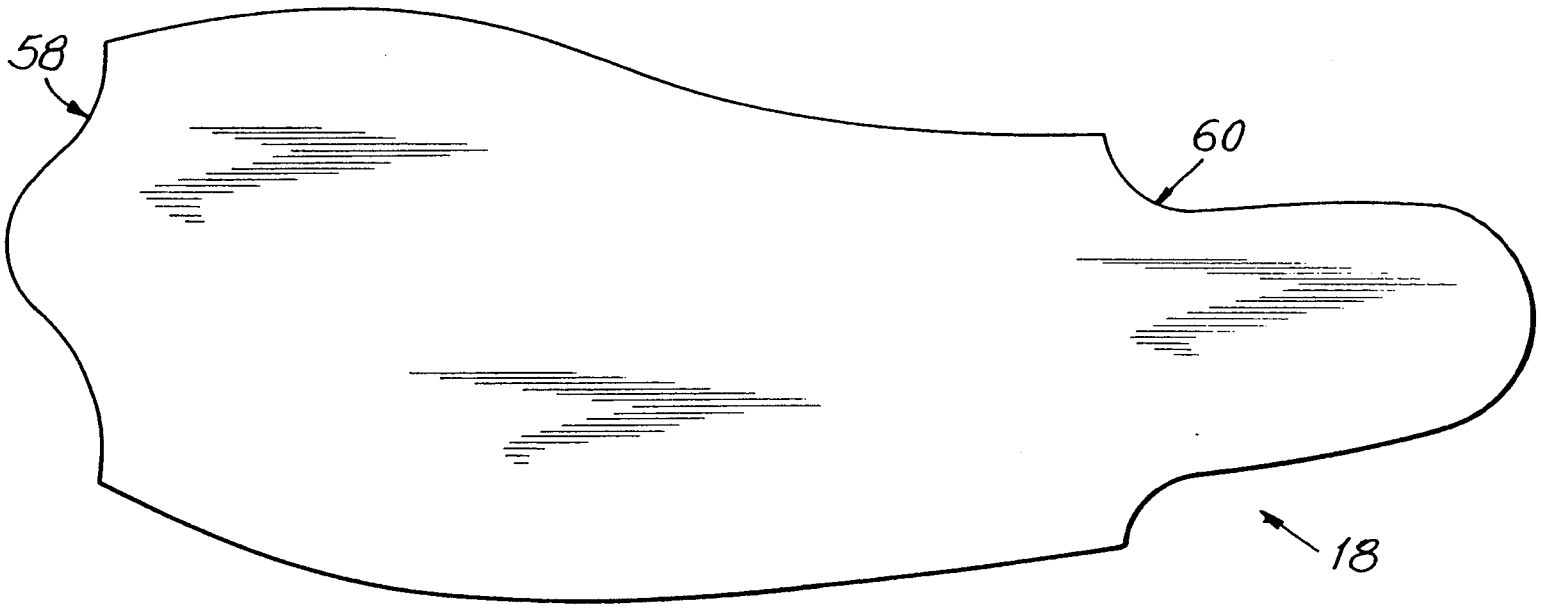
FIG. 6 is a top view of an illustrative embodiment of an insole for the shoe of FIG. 1.
Figure 7:
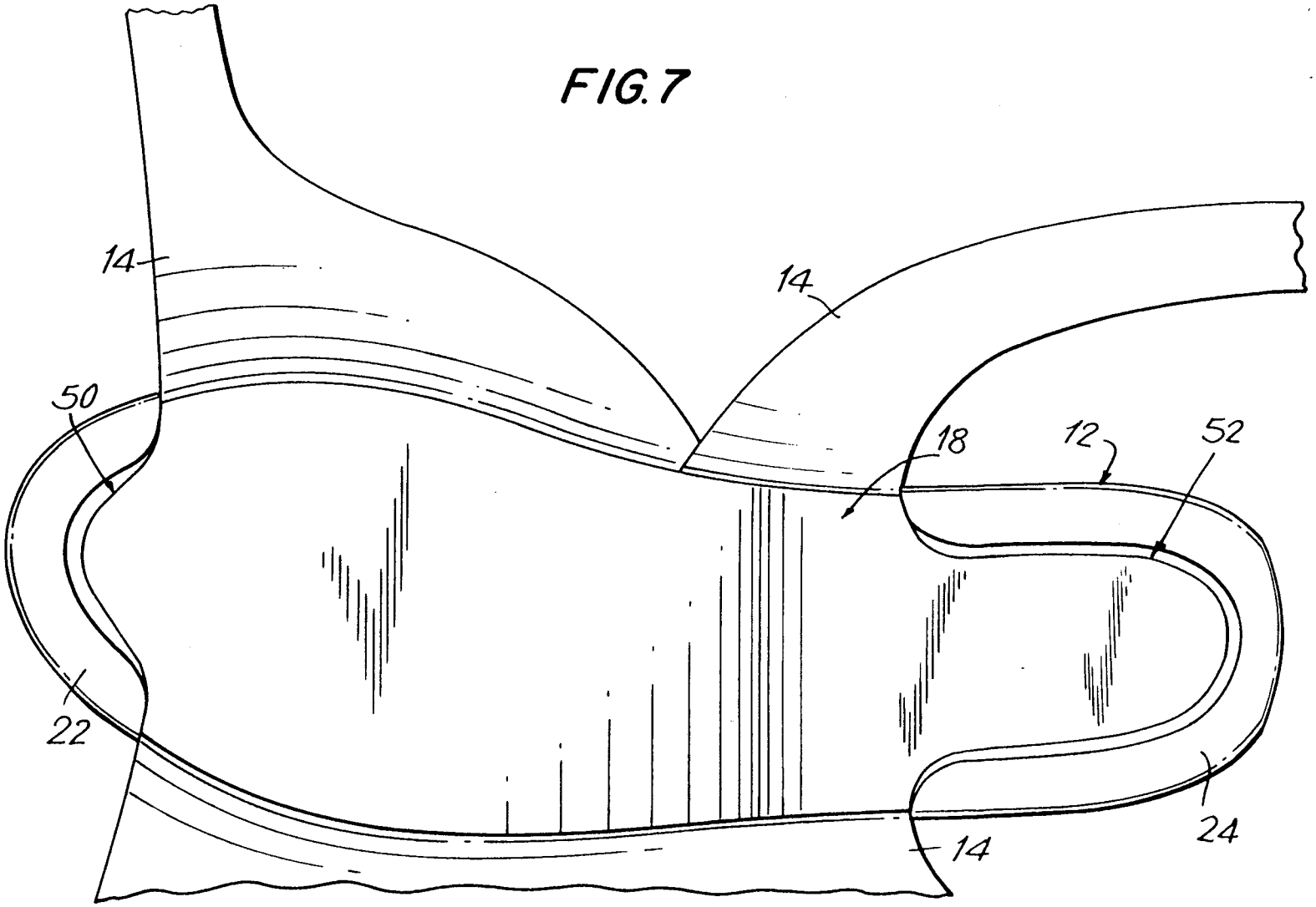
FIG. 7 is a partially fragmentary top view of the shoe of FIG. 1 having the replaceable inner sole removed.

Insole 18 is shown in FIG. 6. Insole 18 can be made of any conventional insole material, such as compressed leather or compressed synthetic fiber. The insole is cemented to upper 14, and the insole and upper are attached to unit bottom 12 in a conventional lasting process, described below. Insole 18 completely covers the portions of upper 14 which are attached to unit bottom 12. When properly inserted, insole 18 fits within recess 20, having contours 58 and 60 substantially abutting recessed contours 50 and 52, as shown in FIG. 7.

Figure 8:
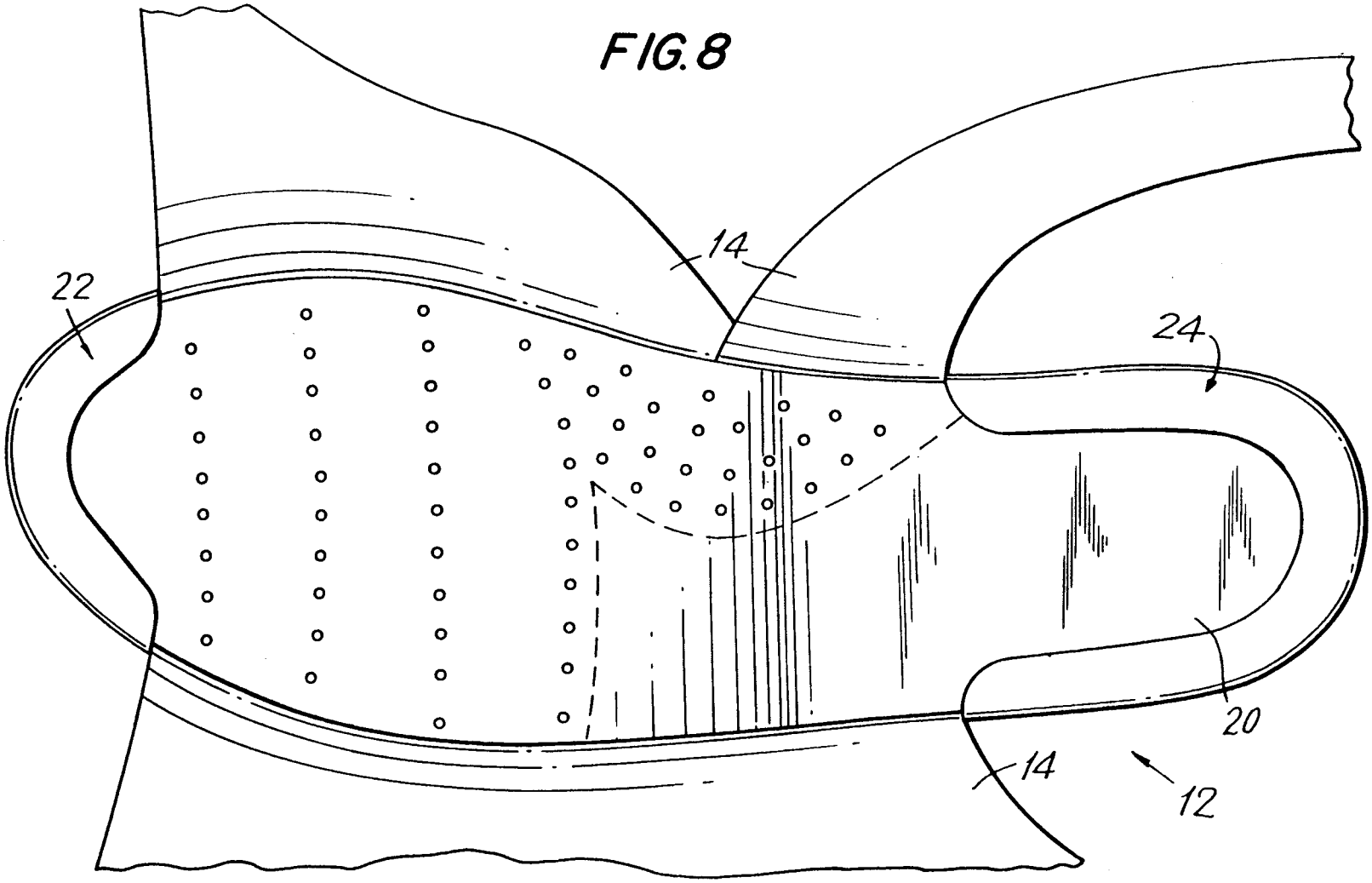
FIG. 8 is a partially fragmentary top view of the shoe shown in FIG. 1 having the replaceable inner sole inserted.

FIG. 8 is a top view of shoe 10, fully assembled, having replaceable inner sole 20 inserted. Inner sole 20 can be of any conventional material, such as microcellular foam or, more specifically, ethylene-vinyl acetate. Inner sole 20 fits beneath flaps 22 and 24, covering insole 18 entirely. Inner sole 20 is easily inserted into and removed from shoe 10 as often as desired. No adhesives or fasteners (other than flaps 22 and 24) are required. To remove inner sole 20, the wearer simply grasps inner sole 20 at a point approximately midway between the toe and the heel portions, and pulls inner sole 20 from beneath flaps 22 and 24. Inner sole 20 may be inserted by first sliding the heel portion of inner sole 20 beneath flap 24 until it is firmly against the back of flap 24. The wearer then arches the middle portion of inner sole 20 upward, and slides the toe portion of inner sole 20 under flap 22.

In alternative embodiments of the invention, shoe 10 has either an open toe or an open heel, but not both. The shoe is constructed in the same manner, but only the open portion (i.e., the toe or heel) is equipped with a flexible flap for retaining inner sole 20.

Figure 9:
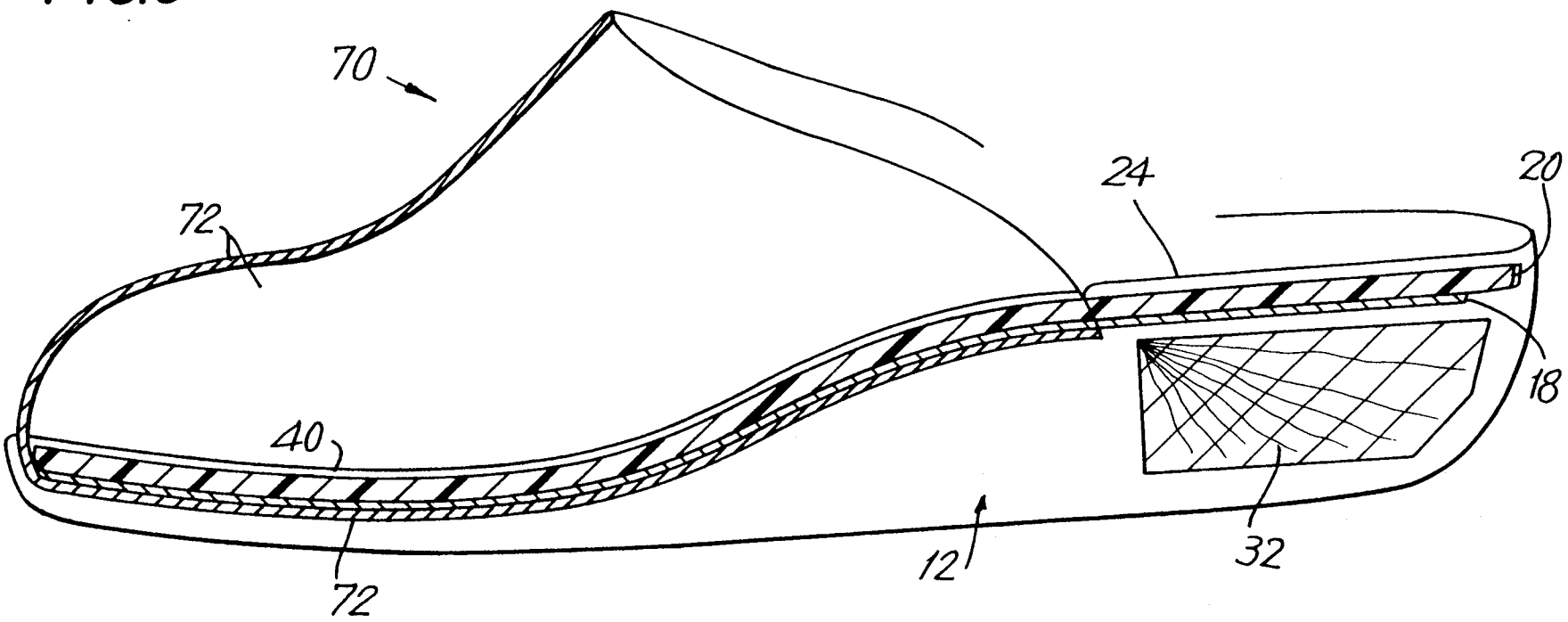
FIG. 9 is a partially fragmentary side elevational view, partly in section, of an alternative embodiment of the invention.

FIG. 9 shows a shoe, designated generally by reference numeral 70, having an open heel and a closed toe upper 72. In this embodiment, replaceable inner sole 20 is retained in the proper position by flap 24 at the heel, and by the pressure of the wearer's foot and closed toe upper 72 at the front. A front flap is not required, because the closed front upper will prevent inner sole 20 from sliding forward.

Figure 10:
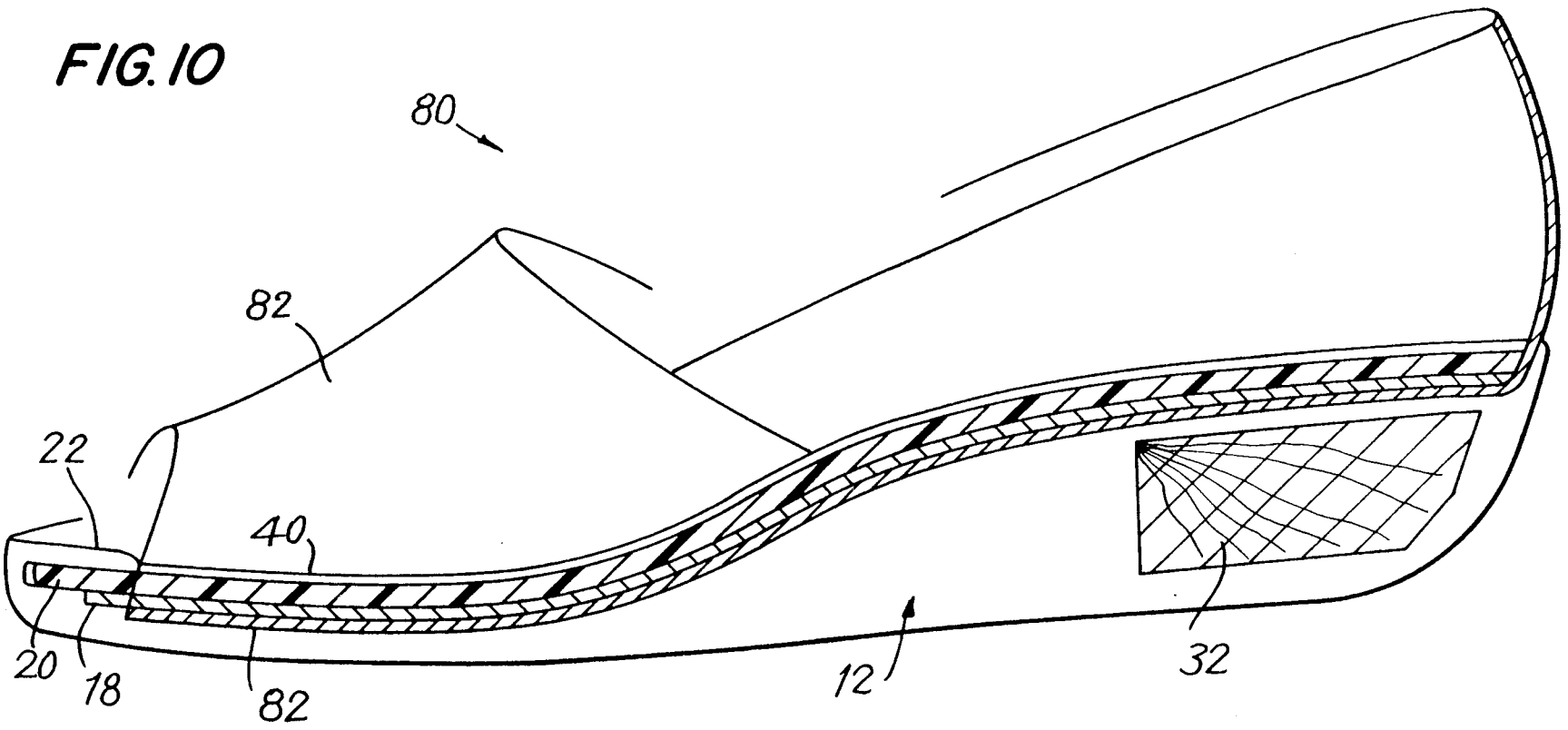
FIG. 10 is a side elevational view, partly in section, of another alternative embodiment of the invention.

FIG. 10 shows a shoe, designated generally by reference numeral 80, having an open toe and a closed heel upper 82. In this embodiment, replaceable inner sole 20 is retained in the proper position by flap 22 at the toe, and by the pressure of the wearer's foot and closed heel upper 82 at the rear. In this embodiment, a rear flap is not required, because the closed heel will prevent inner sole 20 from sliding rearward. Flap 22 prevents inner sole 20 from sliding forward.

Shoes constructed in accordance with this invention are assembled using a conventional shoe lasting process. A last is a shoe manufacturing tool which is shaped like a human foot. The last is used to achieve a proper fit and shape for upper 14, and for sole pressing (i.e., to apply pressure while attaching upper 14 to unit bottom 12). In a well known process, upper 14 is preferably cemented to insole 18, attached to the last, and then attached to unit bottom 12. The last is used to apply pressure to help set the cement holding upper 14 to unit bottom 12. After the cement is set, the last is removed.

Lasts suitable for manufacturing shoes in accordance with this invention must be specially contoured to contact unit bottom 12 during sole pressing without damaging flaps 22 or 24. If a specially contoured last were not used, retaining flaps 22 and 24 would be pressed on and damaged during sole pressing.

Figure 11:
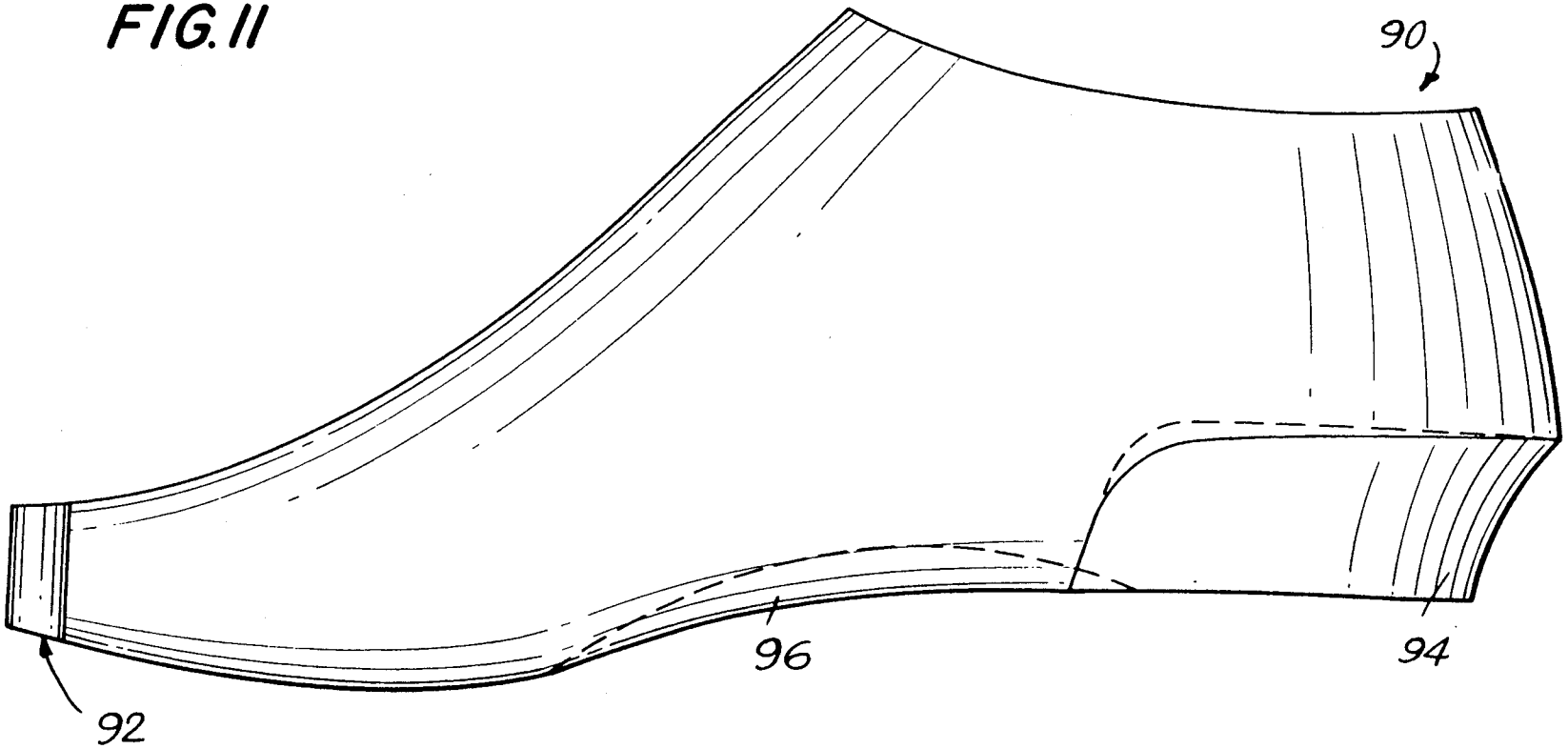
FIG. 11 is a side elevational view of a last used in the manufacture of the shoe of FIGS. 1–8.
Figure 12:
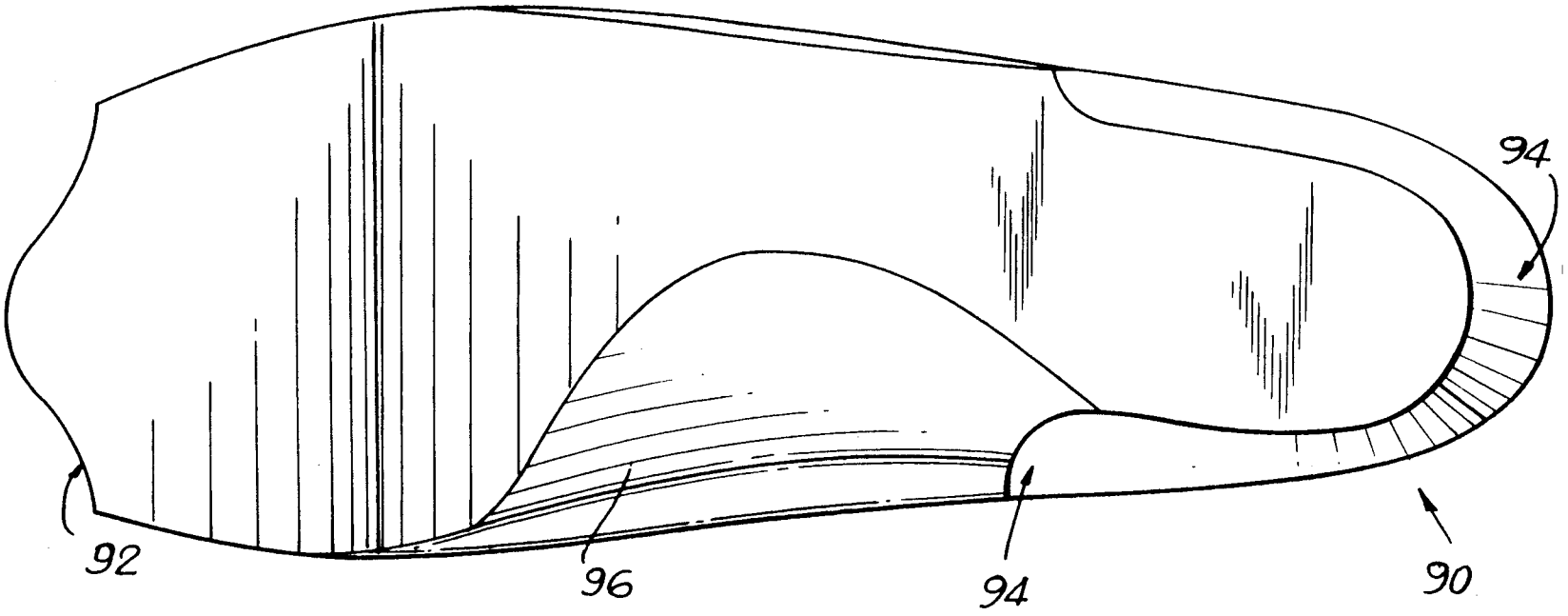
FIG. 12 is bottom view of the last of FIG. 11.

FIG. 11 shows an illustrative embodiment of a last suitable for use in manufacturing the open toe/open heel shoe of FIG. 1. The last, designated generally by reference numeral 90, has recess 92 at the toe portion and recess 94 at the heel portion. Last 90 also has a contour 96 corresponding to the arch portion of shoe 10. FIG. 12 shows a bottom view of last 90. As shown, recesses 92 and 94 are designed to fit contours 50 and 52, respectively, of inset 26 (see FIG. 3).

Variations of last 90 are required to manufacture the shoes shown in FIGS. 9 and 10. Because these shoes use only a single flap (i.e., flap 22 or flap 24), only one of recesses 92 and 94 is required. The last used to press the sole of the open heel shoe of FIG. 9 has recess 94, but has a conventional shape in the toe portion. The last used to press the sole of the open toe shoe of FIG. 10 has recess 92, but has a conventional shape in the heel portion.

Other embodiments of the present invention are possible. For example, the toe portion of shoe 10 may be any of a variety of shapes, and the shape of flap 22 (FIG. 3) will correspond to the toe shape. Also, unit bottom 12 may have a high arch or heel, or it may be flat.

Thus an open toe/open heel shoe having a replaceable inner sole and a simple system for retaining the inner sole in the proper position, regardless of whether or not the shoe is being worn, is provided. One skilled in the art will appreciate that the present invention can be practiced by other than the described embodiments, which are presented here for purposes of illustration and not of limitation, and the present invention is limited only by the claims that follow.

What is claimed is:

1. A shoe having at least one of an open toe or open heel comprising:

a unit bottom with a toe portion and a heel portion, said unit bottom having first and second recesses, said second recess being formed within said first recess;

an upper, said upper being disposed in said second recess and permanently affixed to said unit bottom;

an insole, said insole being disposed in said second recess and permanently affixed to said upper and said unit bottom; and a flap for removably retaining a replaceable inner sole in said first recess, in contact with said unit bottom and said insole, said flap being disposed at at least one of the toe an heel portions of said unit bottom, and extending inwardly from the outer edge o the unit bottom and partially across said first recess, forming a slot at said at least one of the toe and heel portions of said unit bottom to receive a portion of said replaceable inner sole.

2. The shoe of claim 1 wherein said flap is an integral part of the unit bottom.

3. The shoe of claim 1 wherein said flap extends inwardly from the outer edge of the unit bottom about ten millimeters.

4. The shoe of claim 1 wherein the flap is tapered, such that said flap is thickest at the outer edge of the unit bottom and becomes thinner as said flap extends inward.

5. The shoe of claim 1 wherein said unit bottom and said flap are formed by injection molding.

6. The shoe of claim 1 wherein said unit bottom and said flap are formed sing an open-pour molding process.

7. The shoe of claim 1 wherein said unit bottom and said flap are formed of thermoplastic rubber.

8. The shoe of claim 1 wherein said unit bottom and said flap are formed of a material selected from among the group consisting of polyvinyl chloride, ethylene-vinyl acetate copolymer, styrene, and polyurethane.

9. The shoe of claim 1 having a flap at the toe portion and a flap at the heel portion of said shoe; and wherein:

the flap at the toe portion of the unit bottom extends around the front and to the sides of the shoe to prevent forward and lateral slippage of the replaceable inner sole; and the flap at the heel portion of the unit bottom extends around the back and to the sides of the shoe to prevent rearward and lateral slippage of the replaceable inner sole.

10. The shoe of claim 1 having a flap at the heel portion; wherein the flap at the heel portion extends around the back and to the sides of the shoe to prevent rearward and lateral slippage of the replaceable inner sole.

11. The shoe of claim 10 wherein at least a portion of said upper extends around and across the toe portion of the unit bottom.

12. The shoe of claim 1 having a flap at the toe portion; wherein the flap at the toe portion extends around the front and to the sides of the shoe to prevent forward and lateral slippage of the replaceable inner sole.

13. The shoe of claim 12 wherein at least a portion of said upper extends around the heel portion of the unit bottom.

14. The shoe of claim 1 wherein said second recess is contoured such that is does not extend beneath said flaps.

15. A method for securing a replaceable inner sole to the unit bottom of a shoe, comprising:

forming first and second recesses in said unit bottom, said second recess being formed within said first recess;

permanently affixing an upper to said unit bottom in said second recess;

permanently affixing an insole to said upper and said unit bottom;

forming a flap at at least one of the toe portion and the heel portion of said unit bottom, said flap extending inwardly from the outer edge of the unit bottom and over a portion of said recess, creating a slot for removably receiving a portion of said replaceable inner sole; and inserting a portion of said replaceable inner sole into said slot.

16. The method of claim 15, wherein said flap is formed at the heel portion of said unit bottom.

17. The method of claim 15, wherein said flap is formed at the toe portion of said unit bottom.

18. The method of claim 15, wherein:

said flap forming step comprises forming first and second flaps, said first flap disposed at the toe portion and said second flap disposed t the heel portion of said unit bottom, said flaps extending inwardly from the outer edge of the unit bottom and over a portion of said first recess, creating first and second slots, at the toe portion and the heel portion of said unit bottom, respectively, for receiving a portion of said replaceable inner sole; and said inserting step comprises:

inserting a first portion of said replaceable inner sole into said first slot, and inserting a second portion of said replaceable inner sole into said second slot.

* * * * *